US005167424A

United States Patent [19]

Baggio et al.

[11] Patent Number: 5,167,424

[45] Date of Patent: Dec. 1, 1992

[54] VIBRATION DAMPING DEVICE PARTICULARLY FOR SKIS

[75] Inventors: Giorgio Baggio, San Martino di Lupari; Roberto Gorza, Feltre; Mirco Battistella, Breda di Piave, all of Italy

[73] Assignee: Nordica S.p.A., Montebelluna, Italy

[21] Appl. No.: 736,534

[22] Filed: Jul. 26, 1991

[30] Foreign Application Priority Data

Jul. 30, 1990 [IT] Italy ..... 82607 A/90

[51] Int. Cl.[5] ..... A63C 5/075

[52] U.S. Cl. ..... 280/602; 267/141; 267/153; 267/177; 280/607; 280/617; 280/636

[58] Field of Search ..... 280/602, 607, 617, 618, 280/636; 267/150, 153, 166, 141, 177, 169, 170, 175, 178

[56] References Cited

U.S. PATENT DOCUMENTS

| | | | |
|---|---|---|---|
| 3,260,532 | 7/1966 | Heuvel | 280/602 |
| 3,797,844 | 3/1974 | Smolka et al. | 280/617 |
| 3,809,427 | 5/1974 | Bennett | 267/141 |
| 4,294,460 | 10/1981 | Kirsch | 280/617 |

FOREIGN PATENT DOCUMENTS

| | | | |
|---|---|---|---|
| 2122358 | 11/1972 | Fed. Rep. of Germany | 267/141 |
| 2255406 | 5/1974 | Fed. Rep. of Germany . | |
| 2601951 | 7/1977 | Fed. Rep. of Germany . | |
| 3934888 | 5/1990 | Fed. Rep. of Germany | 280/607 |
| 03360 | 10/1983 | PCT Int'l Appl. . | |
| 1555429 | 11/1979 | United Kingdom | 267/141 |

*Primary Examiner*—Eric D. Culbreth
*Attorney, Agent, or Firm*—Guido Modiano; Albert Josif

[57] ABSTRACT

A vibration damping device for skis including a rigid plate for supporting ski boot bindings and having at least two holes which act as seats for at least one rigid spacer. At least one resilient member is arranged coaxially to the rigid spacer, and the spacer interacts with a screw for interconnection with the ski and for supporting the resilient member. The resilient member has a washer for supporting the rigid plate. The device thus allows the optimum damping of the vibrations which occur along an axis which is vertical with respect to the ski, without altering the possibility of transmitting the efforts imparted along different axes.

5 Claims, 2 Drawing Sheets

D1
D2
III
V

VIBRATION DAMPING DEVICE PARTICULARLY FOR SKIS

BACKGROUND OF THE INVENTION

The present invention relates to a vibration damping device particularly for skis.

The problem of limiting the stresses which, during skiing, are transmitted by the ski to the skier's leg is currently felt.

On this subject, a U.S. Pat. No. 3,260,532 discloses a plate having its ends fastened at the central region of a ski; the distance between the plate and the ski can be changed by arranging resilient members therebetween.

This solution has a few disadvantages: the ends of the plate are connected to the ski through layers of rigid rubber or similar materials, so that the damping of vibrations is assigned completely to the resilient members interposed between the ski and the plate.

In view of the rigidity of the structure, it is furthermore observed that the flexing of the ski is considerably limited and that said ski could suffer localized breakage or deformations.

In any case, the possible deflection of the ski would consequently entail a deflection of the plate and therefore a variation in the distance between the tip element and the heel element which are associable with said plate for interconnection with the boot.

This is a problem, since the coupling conditions are altered and the safety conditions for the skier may thus become critical.

In the disclosed variated embodiments one furthermore observes a structurally complicated solution which is subject to malfunctions, due to the many adjustment elements which are provided, and which considerably increases the weight of the ski and also encumbers it aesthetically.

A German patent, no. DE 2255406 filed on Nov. 11, 1972, discloses a ski which has, at the central region, a plate which is associated with said central region and can oscillate freely along a plane which is transverse to the ski itself.

This solution per se has the disadvantage of considerably limiting the skier's sensitivity if he tends to arrange the ski edgeways, since this movement is partially or totally absorbed by the oscillation of the plate with respect to the ski.

This leads to a feeling of insecurity for the skier, due to the not immediate transmission of the efforts to the ski.

A German patent, no. DE 2601951 filed on Jan. 20, 1976, also discloses a plate associated with a ski and interacting rearwardly with the ski by means of the interposition of a blade which can be variously arranged with respect to said ski.

This solution also has disadvantages, since on one hand it is structurally complicated and therefore subject to possible breakage or malfunctions and on the other hand it leads the user to ski in an unnatural position, the plate being in any case inclined by a certain angle with respect to the plane of arrangement of the ski.

A European patent, No. 0104185 filed on Mar. 25, 1983, claiming the priority of a Swiss patent application No. 1850/82 dated Mar. 25, 1982, is also known and discloses a shock-absorber, for skis, substantially constituted by a plate which is rigidly associated with the underlying ski at its ends, a resilient member being interposed in the central region between said plate and said ski.

However, even this solution has disadvantages, since the plate is directly connected to the ski and thus in any case transmits the stresses directly to the boot and thus to the skier's leg.

During the deflection of the ski, the distance between the ends of the tip element and of the heel element is furthermore altered, varying the boot engagement conditions.

SUMMARY OF THE INVENTION

The aim of the present invention is therefore to eliminate the disadvantages described above in known types by providing a device which allows to optimally absorb the vertical vibrations transmitted by the ski, at the same time allowing the skier to have an optimum and immediate transmission of the efforts from the boot to the ski if the latter is arranged edgeways, thus activating the function of the blades.

Within the scope of the above aim, an important object is to provide a device which allows to achieve the above described characteristics together with the possibility of flexing the ski optimally even at the region affected by the bindings.

Another important object is to provide a device which maintains constant the distance between the heel element and the tip element during the ski deflection step.

Another object is to provide a device which is structurally simple and easy to industrialize.

A further object of the present invention is to provide a device which is reliable and safe in use, which has modest costs, and which can be obtained with known and conventional facilities.

This aim, these objects and others which will become apparent hereinafter are achieved by a vibration damping device, particularly for skis, characterized in that it comprises a rigid plate for supporting ski boot binding means, said plate having at least two holes which act as seats for at least one rigid spacer coaxially to which at least one resilient member is arranged, said at least one spacer interacting with means for interconnection with said ski and for supporting said at least one resilient member, said resilient member having supporting means for said rigid plate.

Advantageously, said device has means suitable for limiting the axial stroke, with respect to said at least one spacer, of said at least one resilient member.

BRIEF DESCRIPTION OF THE DRAWINGS

Further characteristics and advantages of the invention will become apparent from the detailed description of some particular but not exclusive embodiments, illustrated only by way of non-limitative example in the accompanying drawings, wherein.

DESCRIPTION OF THE PREFERRED EMBODIMENTS

Figures 1, 2, 3, 4, 5, 6, 7, 8, 9:
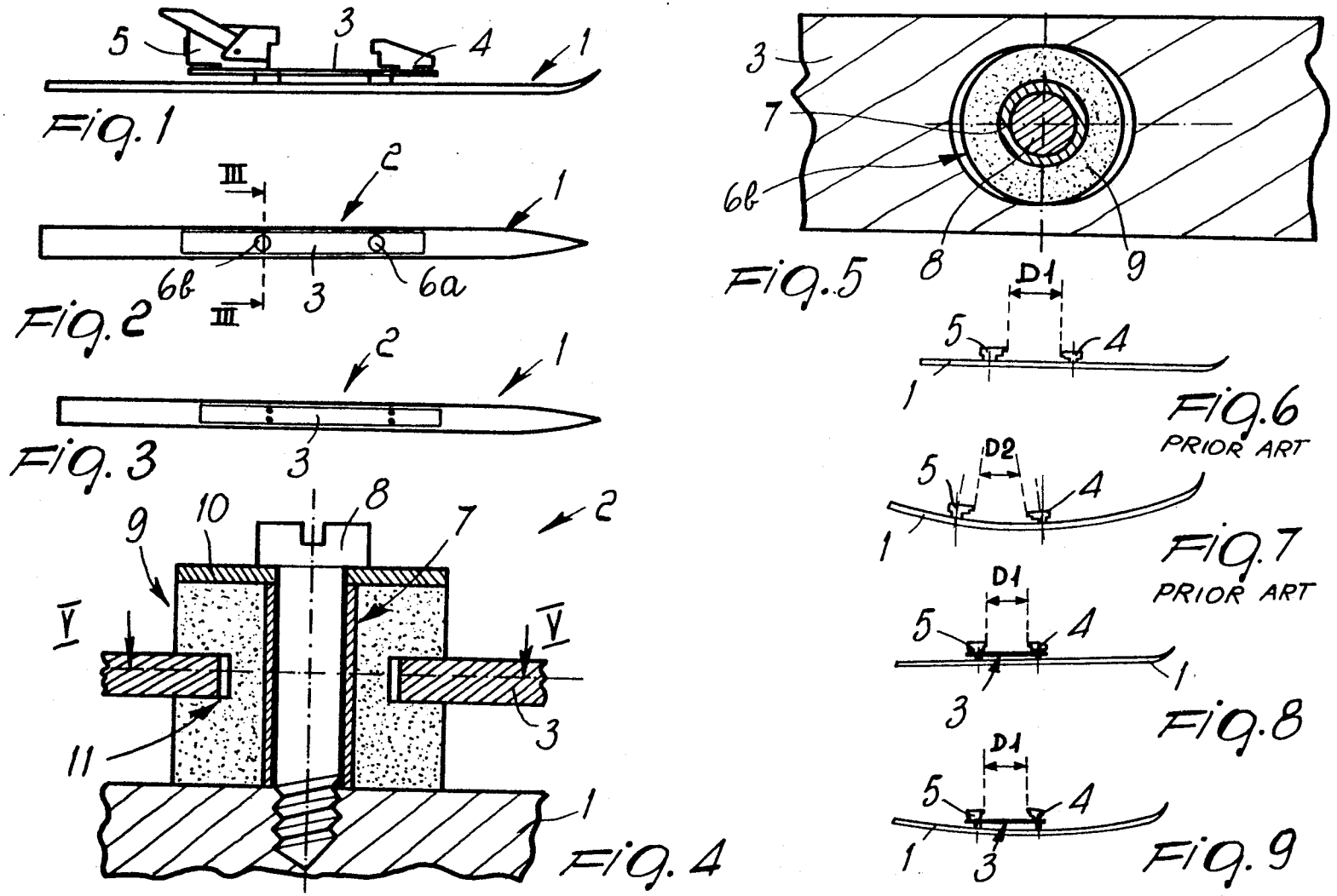
Fig. 6 PRIOR ART
Fig. 7 PRIOR ART
FIG. 1 is a side view of the device according to the invention.
FIGS. 2 and 3 are top views of the device according to the invention applied to a ski.
FIG. 4 is a sectional view taken along the plane III—III of FIG. 2.
FIG. 5 is a sectional view taken along a plane V—V of FIG. 4.
FIGS. 6 and 7 are views of the different arrangement of the bindings for the boot in a conventional ski respectively in case of no deflection and of deflection of said ski.
FIGS. 8 and 9 are views, similar to the preceding ones, of the conditions which can be observed by using the device according to the present invention.

With reference to the above figures, the reference numeral 1 indicates a ski with which a vibration damping device, generally indicated by the reference numeral 2, is associable.

Said device is constituted by a rigid supporting plate 3 for means for coupling to ski boots, which are for example constituted by a tip element 4 and by a heel element 5.

The rigid plate 3, which is preferably not wider than the ski 1 and has such a length as to affect the central region thereof, has at least two holes, indicated by the numerals 6*a* and 6*b*, which act as seats for at least one rigid spacer, indicated by 7.

Alternatively, as illustrated in FIG. 3, more holes may be provided and may be arranged symmetrically, always along an axis which is axial or transverse with respect to the ski.

Said rigid spacer 7 is preferably constituted by a cylinder which is arranged perpendicular to the underlying ski 1 and which interacts with a means for connecting it with said ski which is constituted by a screw 8.

At least one resilient member 9, constituted for example by a rubber cylinder, is arranged coaxially to each of the rigid spacers 7 provided at each of said holes 6*a* and 6*b* and interacts with supporting means which are constituted by a washer 10 which abuts, by means of the head of the screw 8, at the end of the rigid spacer 7 which is not adjacent to the ski 1.

Advantageously, the diameter of the resilient member 9 is equal to that of the washer 10, said washer keeping its position fixed with respect to the ski.

The resilient member 9 has supporting means for the rigid plate 3, said means being constituted by an annular seat 11 which is defined transversely to said resilient member 9 approximately halfway along its height.

Said annular seat 11 naturally has an internal diameter which is slightly smaller than that of the holes 6*a* and 6*b*.

Advantageously, the holes defined at the front or at the rear of the rigid plate 3 can have a slotted shape along an axis which is longitudinal to said rigid plate 3, this allowing the free deflection of the ski 1.

Naturally, if said configuration occurs at the hole 6*b*, necessarily the hole 6*a* has a slightly larger circular diameter than the internal diameter of the annular seat 11 so as to avoid longitudinal slidings of the rigid plate 3 with respect to the ski 1.

The use of the device is thus as follows: once the tip element 4 and the heel element 5 are associated with the rigid plate 3, said rigid plate 3 is interconnected with the resilient members 9 and the assembly is then associated with the ski 1 by means of the screws 8.

The structure thus obtained allows the resilient member 9 to absorb the vertical vibrations which the ski 1 receives as it slides on the snow, said vibrations being transmitted to the resilient member 9 also through the rigid spacer 7 and the washer 10.

The vibrations thus discharge at the resilient member 9, the rigid plate 3 being insulated therefrom since it is not rigidly associated with the ski.

The presence of the rigid spacer 7 furthermore allows to keep unchanged the lateral sensitivity in guiding the ski, since the lateral efforts during edge grip are transmitted rigidly from the leg to the ski through the rigid plate and the rigid spacer.

The rigidity and non-deformability of the rigid plate 3 furthermore allow to keep constant the distance $D_1$ between the facing ends of the tip element 4 and of the heel element 5.

In a conventional ski, as illustrated in FIG. 7, the deflection of said ski in fact leads to a variation in the distance between said ends to a value $D_2$ which is smaller than $D_1$.

The bindings used with the present invention therefore may not need systems for compensating the distance variation, also known as systems for the elastic recovery of the play between said heel and tip elements, and are therefore structurally simpler and thus less expensive.

It has thus been observed that the invention has achieved the intended aim and objects, a device having been provided which allows the optimum damping of vertical vibrations while keeping the lateral effort transmission capability unchanged.

Only the passive stresses which tire the skier's leg, and in particular the knees, are consequently damped, leaving the sensitivity during the edgeways arrangement of the ski unchanged.

The device furthermore allows to keep unchanged the flexibility characteristics of the ski with which it is associated, allowing the deflection of said ski even in the region affected by the bindings.

During this step of deflection of the ski, the distance between the facing ends of the heel element and of the tip element is furthermore kept constant, thus avoiding any and every approach thereof during said deflection.

The device according to the invention is naturally susceptible to numerous modifications and variations, all of which are within the scope of the same inventive concept.

Figure 10:
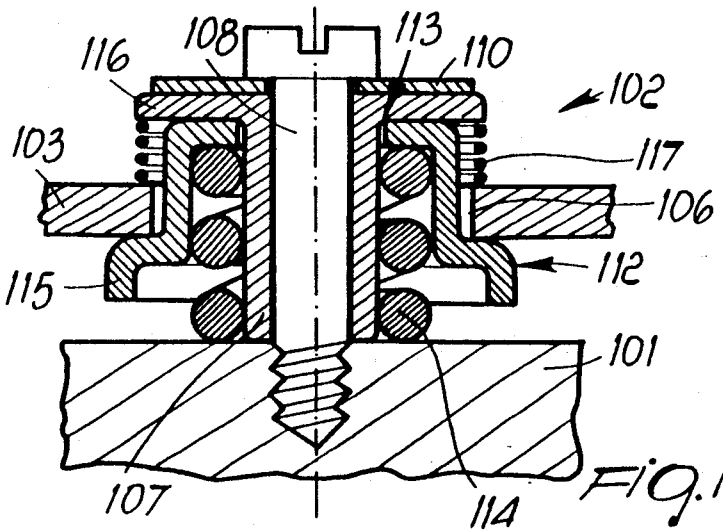
FIG. 10 is a view, similar to that of FIG. 4, of a further embodiment.

Thus, for example, FIG. 10 illustrates a different embodiment of the vibration damping device 102, which comprises a T-shaped rigid spacer 107 which has a cylindrical portion and a head 116 and which is associated with the ski 101 by means of the screw 108 with the interposition of a possible washer 110.

In this embodiment, the rigid spacer 107 interacts with a bush 112 which has the shape of an inverted cup directed toward the ski 101; an opening 113 is defined on the bottom of said bush and is slightly larger in diameter than the outer diameter of the cylindrical portion of said rigid spacer 107.

The internal diameter of the lateral wall of the bush 112 is instead much larger than the outer diameter of the cylindrical portion of the rigid spacer, so as to define a seat for a first resilient member which is constituted by a first spring 114 which is interposed between the bottom of the bush 112 which is adjacent to the head of the screw 108 and the ski 101.

Said bush 112 has, at its open end which is adjacent to the ski 101, an annular raised portion 115 which defines a resting abutment for the rigid plate 103 which thus has an adapted hole 106.

A second resilient member, constituted by a second spring 117, can be interposed between the rigid plate 103 and the overlying head 116 of the rigid spacer 107.

The first spring 114 forces the bottom of the bush 112 into contact with the head 116 of the rigid spacer 107, whereas the second spring 117 forces the rigid plate 103 at the annular raised portion 115 of said bush 112.

The terminal end of the annular raised portion 115 is arranged at a preset distance from the facing surface of the ski 101.

The distance between the end of the annular raised portion 115 and the surface of the ski 101 advantageously corresponds to the maximum extent of the vibration which can be damped by the first spring 114 so as to prevent said spring from packing during the damping of vibrations, thus yielding.

The function of the first and second springs is naturally respectively that of damping the vibrations in the direction of the ski and in the direction of the head 116 of the rigid spacer 107.

Figure 11:
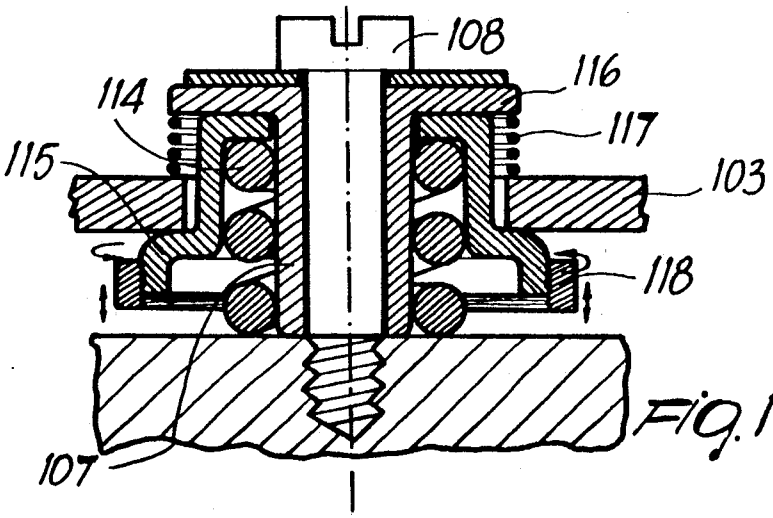
FIG. 11 is a view, similar to the preceding one, of the use of means suitable for limiting the stroke of the resilient member.

Advantageously, FIG. 11 illustrates a means suitable for limiting the axial stroke of the first spring 114, which is constituted by an internally threaded ring 118 which is associated with a complementary thread defined outside the annular raised portion 115.

The skier can thus, by rotating the ring 118, preset the maximum extent of the oscillation of the first spring 114, this depending essentially on variables such as the weight of the skier, the type of snow, the rigidity of the ski and the skiing speed.

Figure 13:
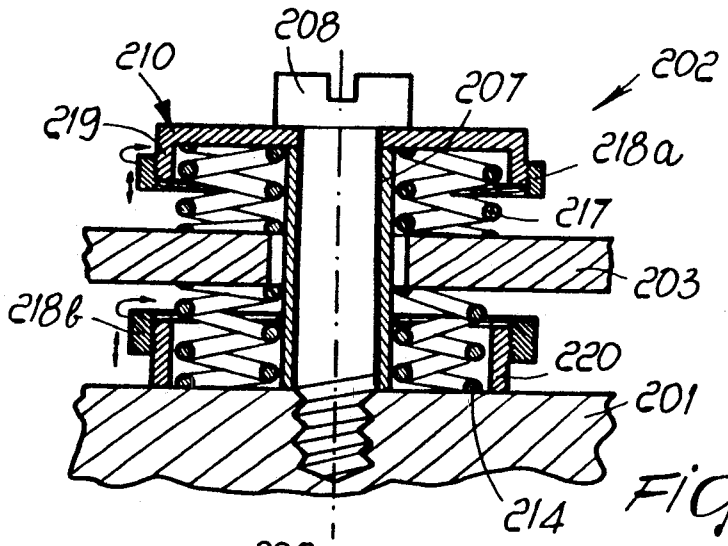
FIG. 13 is a view, similar to the preceding one, of the use of means suitable for limiting the stroke of the resilient member.
Figure 12:
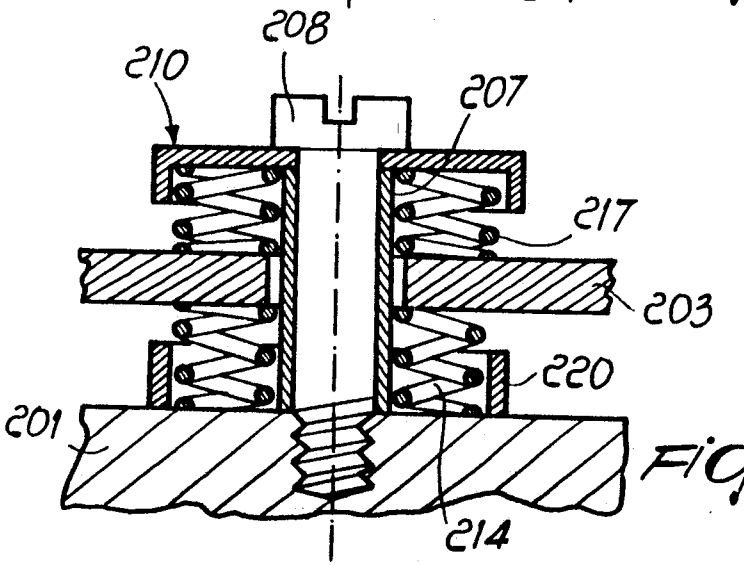
FIG. 12 is a view, similar to that of FIG. 4, of a further embodiment.

FIGS. 12 and 13 illustrate a third embodiment for a vibration damping device 202 which again comprises a rigid spacer 207 which is associated with the ski 201 by means of an adapted screw 208 which interacts with an adapted washer 210 which abuts on said rigid spacer.

In the particular embodiment, the device comprises a first spring 214 and a second spring 217 which are arranged coaxially with respect to the rigid spacer 207 and are respectively interposed between the lower surface of the rigid plate 203 and the facing upper surface of the ski 201 and between the upper surface of the rigid plate 203 and the facing lower surface of the washer 210.

Advantageously, said washer has, at its perimetric edge, a tab 219 which protrudes toward the ski 201 and allows to contain an end of the second spring 217.

Conveniently, said tab 219 can be externally threaded in order to be able to associate therewith a complementarily threaded first ring **218*a* for adjusting the distance between the terminal end of said tab 219 and the underlying surface of the rigid plate 203**.

In order to obtain a similar adjustment for the first spring 214, it is possible to provide, coaxially to said first spring, a cylinder 220; the end of said cylinder which is adjacent to the rigid plate 203 is threaded externally so as to be able to interact with a complementarily threaded second ring **218*b***.

It is thus possible to vary the extent of both the upward and downward oscillations of the rigid plate 203.

The materials of the individual elements which constitute the device may naturally also be the most appropriate according to the specific requirements.

We claim:

1. A vibration damping device for a ski which has a longitudinal extension, comprising:

a rigid plate for supporting ski boot binding means, said rigid plate being provided with at least two through holes;

a rigid spacer having a head and a cylindrical portion, said cylindrical portion extending through a through hole of said at least two through holes of said rigid plate;

means for connecting said rigid spacer to the ski;

a bush which is shaped like an inverted cup which is arranged below said head of said rigid spacer and which is open toward the ski, said bush having a top provided with a hole through which said cylindrical portion of said rigid spacer extends, said bush also having a cylindrical wall which extends towards the ski from said top, said cylindrical wall having an outer diameter, a seat being defined between said cylindrical portion of said rigid spacer and said cylidrical wall of said bush; and a first resilient member which is arranged coaxially to said cylindrical portion of said rigid spacer inside said seat and between said top and the ski;

wherein said cylindrical wall of said bush extends through said through hole of said rigid plate, said through hole of said rigid plate being larger in size than said outer diameter of said cylindrical wall of said bush at least in a direction of said longitudinal extension of the ski, and wherein said bush further comprises an annular raised portion at an end thereof which is opposite said top for supporting said rigid plate.

2. A vibration damping device according to claim 1, further comprising a second resilient member which is arranged coaxially about said cylindrical wall of said bush and which is interposed between said rigid plate and said head of said rigid spacer.

3. A vibration damping device according to claim 1, further comprising a second resilient member which is arranged coaxially about said cylindrical wall of said bush and which is interposed between said rigid plate and said head of said rigid spacer, said first resilient member being constituted by a first spring which forces said top of said bush into contact with said head of said rigid spacer, said second resilient member being constituted by a second spring which biases said rigid plate onto said annular raised portion.

4. A vibration damping device according to claim 1, further comprising means for limiting an axial stroke of said first resilient member which comprise a threaded ring which is adjustably screwed on said annular raised portion of said bush.

5. A vibration damping device according to claim 1, wherein said means for connecting said rigid spacer to the ski comprise:

a screw which extends through said cylindrical portion of said rigid spacer; and a washer interposed between said head of said rigid spacer and said screw.

* * * * *